US009643188B2

(12) United States Patent
Berger

(10) Patent No.: US 9,643,188 B2
(45) Date of Patent: May 9, 2017

(54) VERTICAL ROLLER MILL AND METHOD FOR OPERATING A VERTICAL ROLLER MILL

(71) Applicant: THYSSENKRUPP RESOURCE TECHNOLOGIES GMBH, Beckum (DE)

(72) Inventor: Markus Berger, Ennigerloh (DE)

(73) Assignee: THYSSENKRUPP INDUSTRIAL SOLUTIONS AG, Essen (DE)

( * ) Notice: Subject to any disclaimer, the term of this patent is extended or adjusted under 35 U.S.C. 154(b) by 162 days.

(21) Appl. No.: 14/380,684

(22) PCT Filed: Jan. 22, 2013

(86) PCT No.: PCT/EP2013/051134
§ 371 (c)(1),
(2) Date: Aug. 22, 2014

(87) PCT Pub. No.: WO2013/124106
PCT Pub. Date: Aug. 29, 2013

(65) Prior Publication Data

US 2015/0014455 A1 Jan. 15, 2015

(30) Foreign Application Priority Data

Feb. 24, 2012 (DE) ..... 10 2012 101 489

(51) Int. Cl.
*B02C 15/00* (2006.01)
*B02C 15/14* (2006.01)

(52) U.S. Cl.
CPC ..... *B02C 15/00* (2013.01); *B02C 15/006* (2013.01); *B02C 15/14* (2013.01)

(58) Field of Classification Search
CPC ..... B02C 15/00; B02C 15/006; B02C 15/14
(Continued)

(56) References Cited

U.S. PATENT DOCUMENTS 8,109,459 B2 * 2/2012 Nissen ..... B02C 15/14 241/120

FOREIGN PATENT DOCUMENTS

DE 3520937 A1 12/1985
DE 19702854 A1 7/1998
(Continued)

OTHER PUBLICATIONS

German Language International Search Report for International patent application No. PCT/EP2013/051134; mailing date Jan. 8, 2014.

(Continued)

*Primary Examiner* — Mark Rosenbaum
(74) *Attorney, Agent, or Firm* — thyssenkrupp North America, Inc.

(57) ABSTRACT

The invention relates to a vertical roller mill and a method for operating a vertical roller mill, wherein the grinding assemblies thereof, consisting of a grinding table and at least one grinding roller, interact such that material to be ground is comminuted in the grinding bed between the grinding table and the at least one grinding roller, wherein at least one grinding assembly is driven and at least one grinding assembly is pulled, and the pulled grinding assembly is braked in order to increase the flow of energy through the grinding bed between the grinding table and the at least one grinding roller.

14 Claims, 5 Drawing Sheets

(58) Field of Classification Search
USPC ..... 241/117–121
See application file for complete search history.

(56) References Cited

FOREIGN PATENT DOCUMENTS

| | | | |
|---|---|---|---|
| DE | 102007033256 | A1 | 1/2009 |
| JP | 58-159854 | A | 9/1983 |
| JP | 2011245372 | A | 12/2011 |

OTHER PUBLICATIONS

English Translation of International Search Report for International patent application No. PCT/EP2013/051134; mailing date Jan. 8, 2014.
English language abstract of German Patent Application No. DE102007033256.
English language abstract of German Patent No. DE19702854.
English language abstract of German Patent No. DE3520937.
English Language Abstract for JP2011245372.
Machine Translation of Description of JP58-159854.

* cited by examiner

VERTICAL ROLLER MILL AND METHOD FOR OPERATING A VERTICAL ROLLER MILL

CROSS REFERENCE TO RELATED APPLICATIONS

This application is a U.S. National Stage Entry of International Patent Application Serial Number PCT/EP2013/051134, filed Jan. 22, 2013, which claims priority to German patent application no. DE 102012101489.2, filed Feb. 24, 2012.

FIELD

This invention relates to a vertical roller mill and method for operating a vertical roller mill.

BACKGROUND

Vertical roller mills which, in relation to other grinding systems, such as, for example, tube mills, make possible a significant saving in energy, are increasingly employed for producing powder-type materials for the binding-agent industry.

DE 10 2007 033 256 A1 discloses a vertical roller mill having a driven grinding plate, wherein the grinding plate drives the grinding rollers via the grinding bed. However, this leads to high variations in performance and thus to high loads on the drive train, requiring correspondingly high safety factors in the drive train. On the other hand, input power and also comminution are also subject to high variation and can be only conditionally controlled via the material bed.

DE 35 20 937 A1 furthermore discloses a roller mill having a table which is rotatably mounted about a vertical axle and which, on its upper side, is provided with an annular groove and which interacts with spherically configured grinding rollers, wherein a gap in which material to be ground is crushed and ground is configured between the spherical circumferential part of the grinding rollers and the annular groove.

It has, therefore, already been proposed in DE 197 02 854 A1 that the grinding rollers be driven. It has also been pointed out there that the individual grinding rollers are coupled to one another in the manner of a rotary drive via the grinding plate and the material to be ground located thereon, or the bed of material to be ground, respectively, on the one hand, and, on the other hand, may have greatly differing input powers which may be caused for example by differing rolling diameters on the grinding plate (rolling point/diameter), differing effective diameters of the individual grinding rollers (e.g. on account of wear) and by differing behavior during draw-in of the material to be ground when interacting on the grinding plate and the grinding roller.

Even slight changes in revolutions between individual grinding rollers have the effect of comparatively high performance variations in the individual drives. This may lead to the grinding rollers in part being accelerated and decelerated, such that the individually driven grinding rollers work against one another, leading to a significantly higher force and/or energy requirement during the comminuting operation.

It has, therefore, been proposed in DE 197 02 854 A1 that the variations during operation between the individual rotational drives of all driven grinding rollers are balanced by way of a common performance-balancing regulator.

The fines content of the material to be ground which can be achieved with vertical mills, however, is lower than in other grinding systems, such as, for example, tube mills, which, in the production of binding agents, may have a negative effect on the binding-agent properties.

SUMMARY

The present invention is thus based on the object of improving the vertical roller mill and the method for operating the vertical roller mill such that the fines content per contact of the grinding tool (comminution progress during exposure in the grinding bed between grinding roller and grinding plate) is increased.

Disclosed herein is a vertical roller mill and a method for operating a vertical roller mill. In an aspect of the present disclosure, grinding assemblies comprising a grinding plate and at least one grinding roller interact in such a manner that material to be ground is comminuted between the grinding plate and the at least one grinding roller, wherein at least one grinding assembly is driven and at least one grinding assembly is trailed.

BRIEF DESCRIPRION OF THE DRAWING

The present disclosure is described in detail below with reference to the attached drawing figures, wherein.

DETAILED DESCRIPTION

In the method for operating a vertical roller mill, according to the invention, the grinding assemblies thereof, which are composed of a grinding plate and at least one grinding roller, interact in such a manner that material to be ground is comminuted in the grinding bed between the grinding plate and the at least one grinding roller, wherein at least one grinding assembly is driven and at least one grinding assembly is trailed and, for increasing the flow of energy through the grinding bed between the grinding plate and the at least one grinding roller, the trailed grinding assembly is braked.

The vertical roller mill according to the invention displays at least one driven and at least one trailed grinding assembly, wherein the grinding assemblies are formed by a grinding plate and at least one grinding roller which interact in such a manner that material to be ground is comminuted in the grinding bed between the grinding plate and the at least one grinding roller. The trailed grinding assembly, for increasing the flow of energy through the grinding bed between the grinding plate and the at least one grinding roller, moreover interacts with a brake unit for braking the trailed grinding assembly. The trailed grinding assembly is not driven by way of a drive but is set in rotation merely via the material to be ground.

Figure 1:
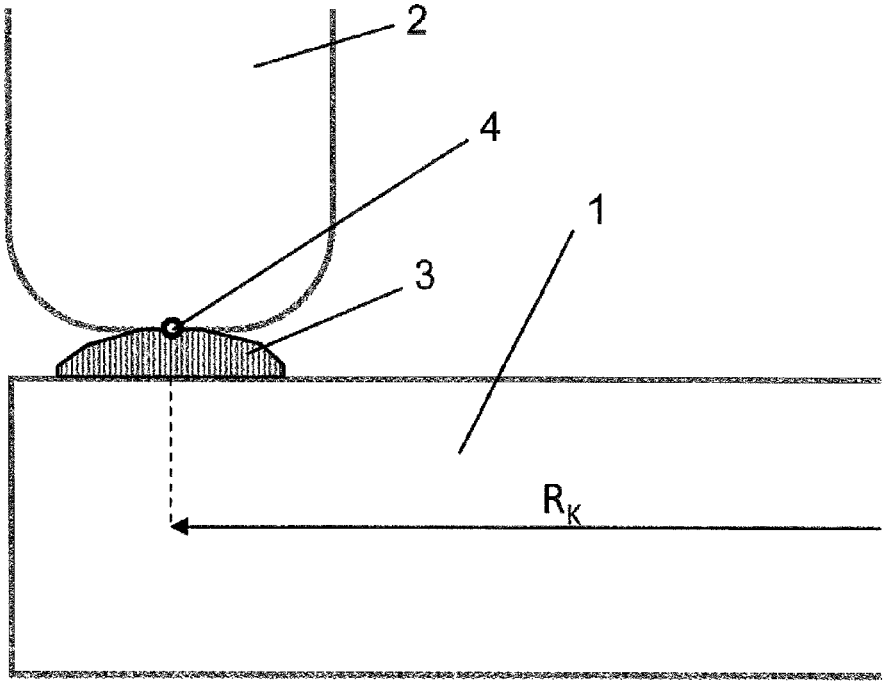
FIG. 1 is a schematic detail view of an embodiment of a vertical roller mill of the present disclosures, depicting a contact point of force.

Increasing the flow of energy through the grinding bed results in an increase of slippage between the grinding plate and the at least one grinding roller, which is explained in more detail in the following by means of FIGS. 1 to 3. There, a grinding plate 1, a grinding roller 2, and the grinding bed 3 are illustrated in a schematic manner The contact point of force of the grinding roller 2 on the grinding bed 3 is identified with the reference sign 4. Slippage is defined by the speed differential $\Delta v_s$ between the circumferential speed of the grinding roller 2 in the contact point of force 4 and the circumferential speed of the grinding plate 1 in the contact point of force (radius $R_K$) which is projected perpendicularly downward onto the grinding plate 1.

Figure 2:
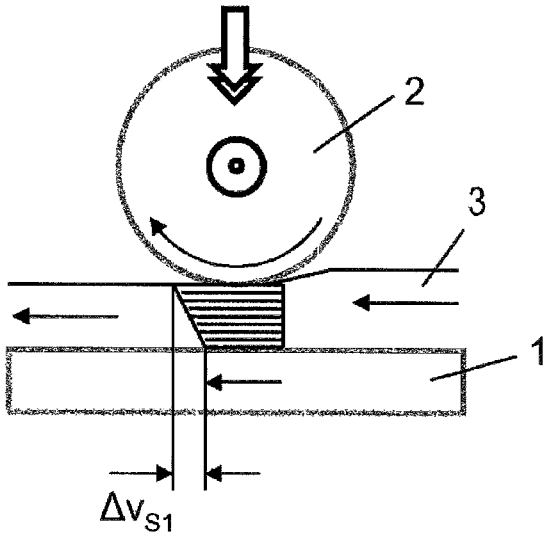
FIG. 2 is a schematic side view of an embodiment of a vertical roller mill of the present disclosure, depicting slippage for a driven grinding roller and a trailed grinding plate.

FIG. 2 shows an example having a driven grinding roller 2 and a trailed grinding plate 1, in the region of the contact point of force 4. It is clearly evident here that the upper layer of the grinding bed 3 which comes into contact with the grinding roller 2 displays a higher speed than the lower layer which is in contact with the trailed grinding plate 1. The difference between the maximum and minimum speed is identified as slippage $\Delta v_{S1}$.

Figure 3:
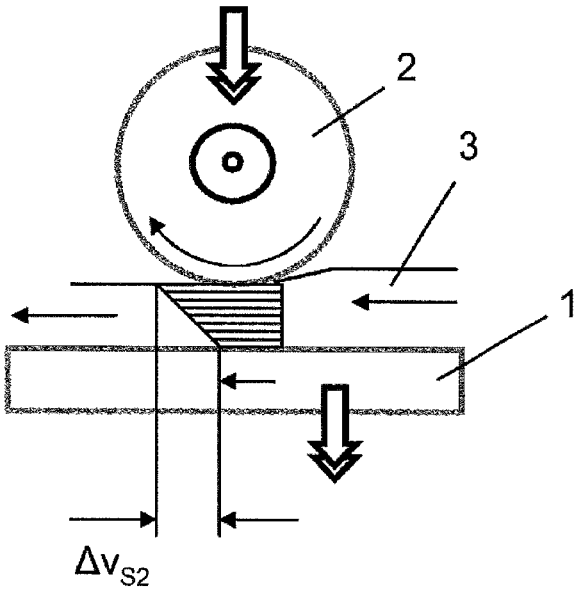
FIG. 3 is a schematic side view of an embodiment of a vertical roller mill of the present disclosure, depicting slippage in the case of a driven grinding roller and a braked grinding plate.

In FIG. 3, the trailed grinding plate 1 is additionally braked. While the speed in the uppermost layer of the grinding bed 3 remains substantially unchanged, the speed of the lower layer which is in contact with the grinding plate 1 is reduced. Accordingly, slippage $\Delta v_{S2}$ in FIG. 3 is greater than slippage $\Delta v_{S1}$ in the situation as per FIG. 2. However, if the grinding-plate speed is influenced by a regulator (constant speed, for example), the speed of the layer in contact with the grinding roller 2 is increased.

Slippage $\Delta v_{S1}$ of FIG. 2 that arises substantially depends on the normal force which acts on the grinding bed via the grinding roller, the grinding bed 3, the geometry of the grinding rollers and the grinding plates, and on the transmitted torque. On account of targeted braking of a grinding assembly (increasing the flow of energy through the grinding bed), in this case braking the grinding plate 1 in FIG. 3, slippage $\Delta v_{S2}$ is increased with the same normal force, leading to an increased shear load in the grinding bed 3. In turn, this has the direct effect of a higher fines content per passage.

Further embodiments of the invention are the subject matter of the dependent claims.

Increasing the flow of energy through the grinding bed may be implemented in a variety of manners. Accordingly, a grinding roller may be driven and the grinding plate may be braked, for example, or at least the grinding plate may be driven and at least one grinding roller may be braked. According to a preferred embodiment of the invention, during braking of one grinding assembly, energy which is used for driving the other grinding assembly is generated. On account of feeding back the braking energy, the energy consumption of the entire system is only slightly increased while, in contrast, the grinding efficiency in the case of a desired target fineness is significantly increased.

It may furthermore be provided that, for regulating the flow of energy through the grinding bed, slippage between the grinding plate and the at least one grinding roller is regulated in a prespecified range. To this end, in particular the rotational speed of the braked grinding assembly may be determined and used for regulating. It is furthermore conceivable that slippage between the grinding plate and at least one grinding roller is regulated depending on the fines content of the comminuted material to be ground.

It has been demonstrated in the experiments on which the invention is based that the braked grinding assembly is expediently braked in such a manner in relation to the driven grinding assembly that slippage between the grinding plate and the at least one grinding roller is regulated in a range of 3-10%. The braked assembly may furthermore be braked in such a manner in relation to the driven grinding assembly that slippage between the grinding plate and the at least one grinding roller, in relation to an unbraked and merely trailed grinding assembly, is increased by 15-100%.

In the physical embodiment of the vertical roller mill the at least one driven grinding assembly may be formed by at least one grinding roller which interacts with a grinding-roller drive and the at least one trailed grinding assembly may be formed by the grinding plate which interacts with a brake unit. It would, however, also be conceivable for the at least one driven grinding assembly to be formed by the grinding plate which interacts with a grinding-plate drive and for the at least one trailed grinding assembly to be formed by at least one grinding roller which interacts with the brake unit. The braking effect may be formed, in particular, by a generator.

Figure 4:
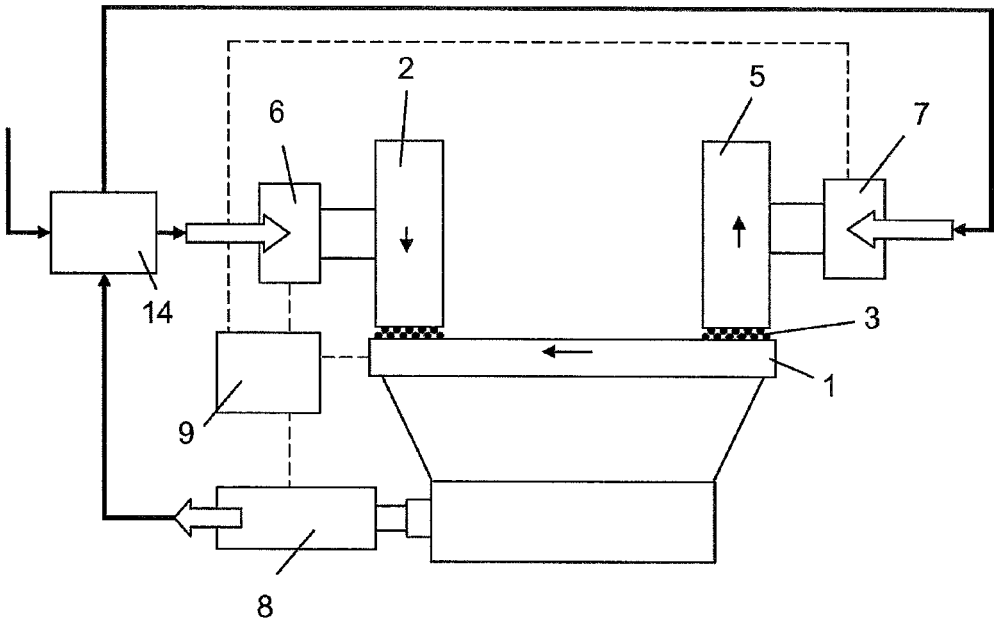
FIG. 4 is a schematic illustration of a vertical roller mill of the present disclosure having driven grinding rollers and a braked grinding plate.

In the exemplary embodiment according to FIG. 4 two grinding rollers 2, 5 are driven via associated grinding-roller drives 6, 7. The grinding plate 1 is trailed via the grinding bed 3 and is operatively connected to a brake unit 8 for regulating slippage between the grinding plate 1 and the grinding rollers 2, 5. Furthermore, a regulator unit 9 which is connected to the grinding-roller drives 6, 7 and the brake unit 8 is provided. Actually existing slippage may be determined via sensors, in particular sensors for detecting the rotational speeds of the grinding plate 1 and, if applicable, the grinding rollers 2, 5, for example.

The brake unit 8 here is configured as a generator in order to generate energy when the grinding plate 1 is braked that may be used for the grinding-roller drives 6 and/or 7, via a common intermediate energy storage device 14.

If the grinding plate 1, according to FIG. 4, is not additionally braked, slippage $\Delta v_{S1}$ according to FIG. 2 would arise. If the grinding plate 1 is additionally braked via the brake unit 8, according to FIG. 3, slippage increases to $\Delta v_{S2}$. On account thereof, an increased shear load within the grinding bed 3 is generated since the speed differential within the grinding bed is increased. The additional shear load has the effect of a higher fines content per passage. One may, therefore, also imagine slippage being regulated depending on the fines content of the comminuted material to be ground. To this end, the fines content in the comminuted material to be ground would be determined and used for regulating.

Figure 5:
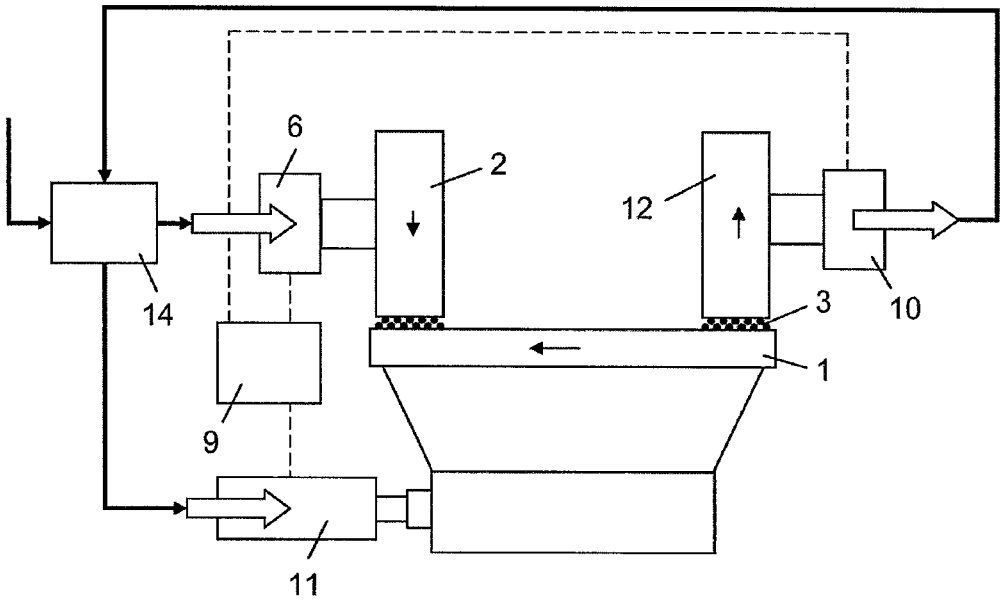
FIG. 5 is a schematic illustration of a vertical roller mill of the present disclosure having a driven grinding plate, and one driven and one braked grinding roller.

In the exemplary embodiment according to FIG. 5 the grinding plate 1 is driven via a grinding-plate drive 11. Furthermore, the grinding roller 2 is driven via the grinding-roller drive 6. On the other hand, one grinding roller 12 is braked via a brake unit 10. Here too, the braking energy created herein may be used for driving the grinding roller 2 and/or the grinding plate 1. Again, slippage between the grinding roller 12 and the grinding plate 1 may be regulated in a prespecified range via the regulator unit 9. The variant according to FIG. 5 has the advantage of greater flexibility of the mill, wherein, in particular a high proportion of fine material at increased throughput may be implemented.

Figure 6:
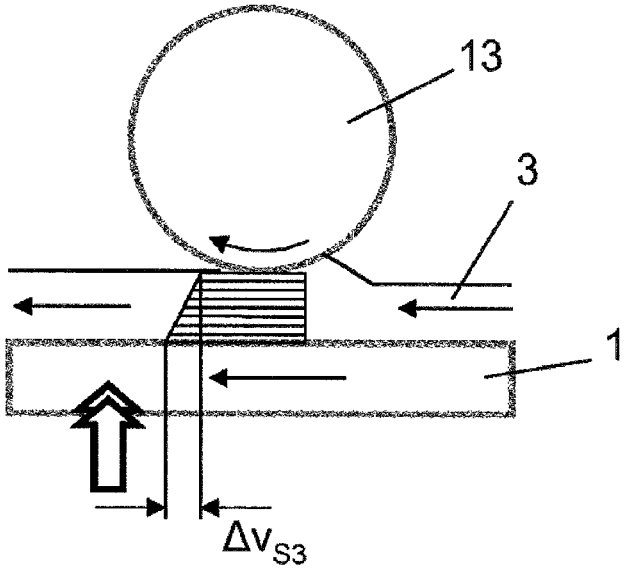
FIG. 6 is a schematic side view of an embodiment of a vertical roller mill of the present disclosure, depicting slippage in the case of a driven grinding plate and a trailed grinding roller.
Figure 7:
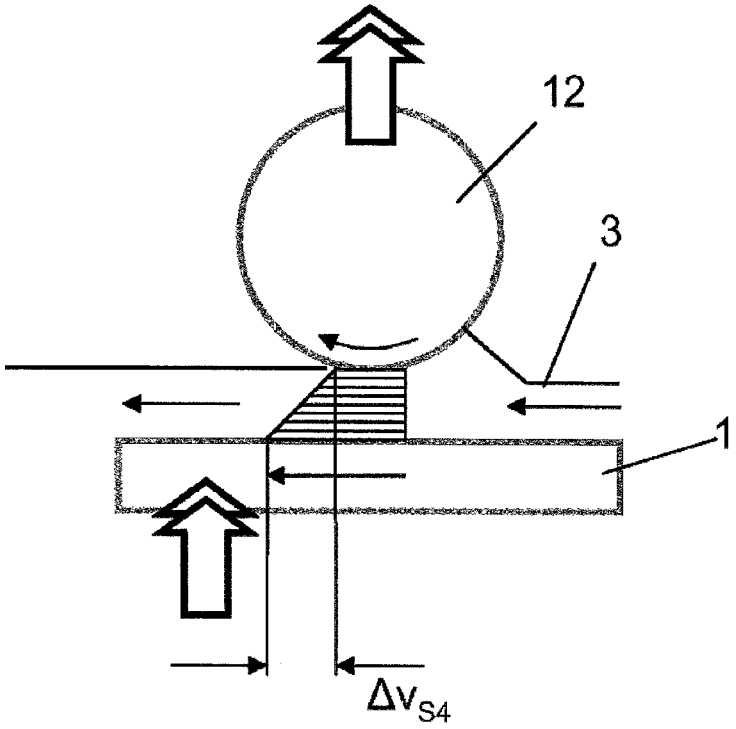
FIG. 7 is a schematic side view of an embodiment of a vertical roller mill of the present disclosure, depicting slippage in the case of a driven grinding plate and a braked grinding roller.

In FIGS. 6 and 7 the situation of slippage between a merely trailed or braked grinding roller, respectively, and a driven grinding plate is illustrated, wherein the grinding roller 13 in FIG. 6 is merely trailed and the grinding roller 12 in FIG. 7 is additionally braked. Here too, it is evident that on account of additionally braking the grinding roller 12, slippage between the grinding roller 12 and the grinding plate 1, or the shear load within the grinding bed 3, respectively, is again increased ($\Delta v_{S3}<\Delta v_{S4}$).

Figure 8:
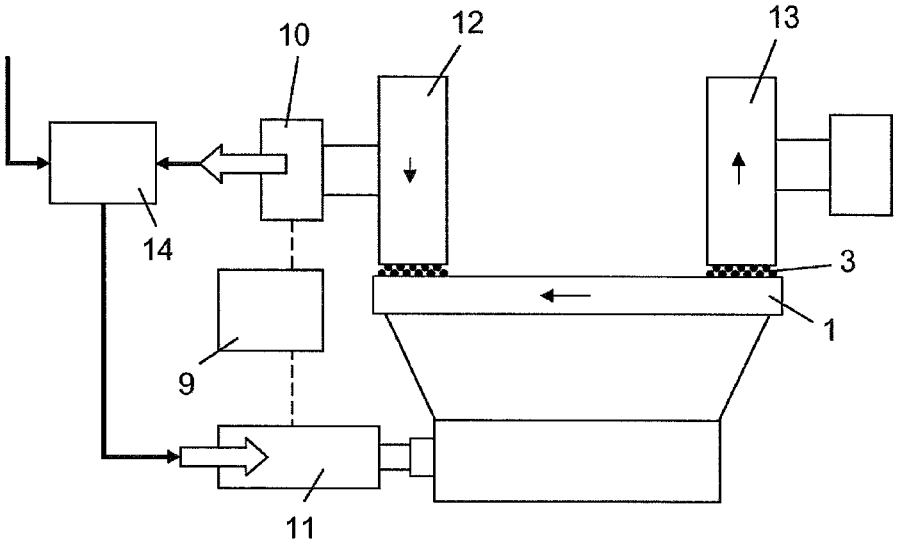
FIG. 8 is a schematic illustration of a vertical roller mill having a driven grinding plate, a braked grinding roller, and a trailed grinding roller.

In FIG. 8 a grinding plate 1 which is driven via a grinding-plate drive 11 is combined with a grinding roller 12 which is braked via a brake unit 10 and a merely trailed grinding roller 13. The setting of slippage between the braked grinding roller 12 and the grinding plate 1 again takes place via the regulator unit 9. The energy recuperated in the braking procedure may also be used for driving the grinding plate 1. Slippage which results in this manner in the region of the grinding rollers 12 and 13 is likewise evident from FIGS. 6 and 7.

Figure 9:
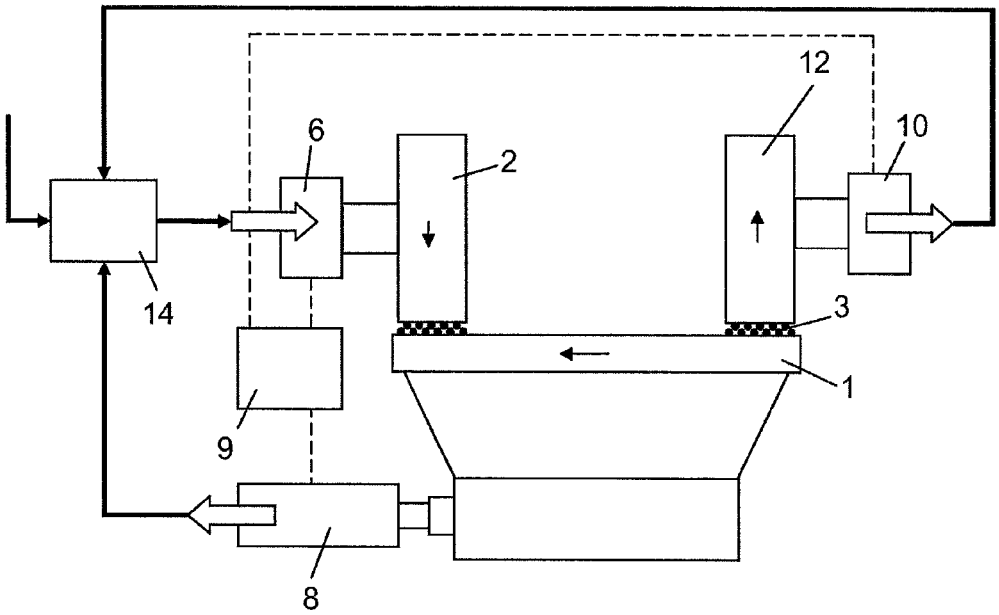
FIG. 9 is a schematic illustration of a vertical roller mill having a braked grinding plate, a braked grinding roller, and a driven grinding roller.

Finally, in FIG. 9 an exemplary embodiment is illustrated in which a braked grinding plate 1 is combined with a driven grinding roller 2 and a braked grinding roller 12.

The grinding-plate drive 11 and the brake unit 10 of the grinding plate are expediently implemented by way of an assembly which may selectively be capable of driving or braking. The grinding-roller drives 6 and/or 7 and the brake unit 12 may also be formed by an assembly which can implement both objectives.

Of course, in all illustrated variants more than two grinding rollers may also be provided, wherein each of the additional grinding rollers may be either driven, braked or merely trailed.

It has been demonstrated in the experiments on which the invention is based that slippage between a driven and a braked grinding assembly is expediently to be regulated in a range of 3-10%, in order to significantly increase the proportion of fines content, on the one hand, and to keep the additional energy requirement within reasonable limits, on the other hand. This means that the speed of the grinding bed in the contact region of the driven grinding assembly is higher by 3-10% than the speed of the grinding bed in the contact region of the braked grinding assembly.

The invention claimed is:

1. A method of operating a vertical roller mill having a grinding plate and at least one grinding roller that are together configured to comminute material-to-be-ground by grinding the material there between, wherein the grinding plate is a grinding assembly and the at least one grinding roller is a grinding assembly, wherein one of the grinding assemblies is driven and another of the grinding assemblies is trailed, the method comprising:

conveying the material-to-be-ground onto the grinding plate of the vertical roller mill to form a grinding bed of the material-to-be-ground;

driving the driven grinding assembly so as to move the grinding bed between the grinding plate and the at least one grinding roller and comminute the material-to-be-ground in the grinding bed;

braking the trailed grinding assembly to effect an increase in an amount of slippage between the grinding plate and the at least one grinding roller, and an increase in a flow of energy and shear load through the grinding bed between the grinding plate and the at least one grinding roller.

2. The method of claim 1, wherein the at least one grinding roller is the grinding assembly that is driven and the grinding plate is the grinding assembly that is braked.

3. The method of claim 1, wherein the grinding plate is the grinding assembly that is driven and the at least one grinding roller is the grinding assembly that is braked.

4. The method of claim 1, further comprising generating energy from said braking step to be used in said driving the driven grinding assembly.

5. The method of claim 1, wherein the flow of energy through the grinding bed is regulated in a prespecified range by an amount of slippage occurring between the grinding plate and the at least one grinding roller.

6. The method of claim 5, further comprising determining a rotational speed of the trailed grinding assembly that is braked so as to regulate the amount of slippage between the grinding plate and the at least one grinding roller.

7. The method of claim 5, wherein the amount of slippage between the grinding plate and the at least one grinding roller is regulated in a range of about 3% to about 10%.

8. The method of claim 5, wherein the amount of slippage between the grinding plate and the at least one grinding roller is regulated based on the fines content of the comminuted material to be ground.

9. The method of claim 5, wherein the amount of slippage occurring between the grinding plate and the at least one grinding roller is increased by between 15% and 100%, as compared to an amount of slippage occurring in a trailed grinding assembly that is not braked.

10. A vertical roller mill comprising:

a grinding plate, wherein the grinding plate is a grinding assembly;

a grinding roller disposed opposite the grinding plate and defining a grinding bed disposed there between, wherein the grinding roller is a grinding assembly, the grinding plate and the grinding roller being configured to comminute material-to-be-ground that passes between said grinding plate and said grinding roller in the grinding bed, wherein one of the grinding assemblies is driven and another of the grinding assemblies is trailed;

a drive unit connected to and configured to drive the driven grinding assembly; and a brake unit connected to and configured to brake the trailed grinding assembly so as to increase a flow of energy through the grinding bed between said grinding plate and the grinding roller.

11. The vertical roller mill of claim 10, wherein said drive unit is in communication with said grinding roller and configured to drive said grinding roller, and wherein said brake unit is in communication with said grinding plate and configured to brake said grinding plate with respect to said grinding bed and said driven grinding roller.

12. The vertical roller mill of claim 10, wherein said drive unit is in communication with said grinding plate and configured to drive said grinding plate, and wherein said brake unit is in communication with said grinding roller and configured to brake said grinding roller with respect to said grinding bed and said driven grinding plate.

13. The vertical roller mill of claim 10, wherein said brake unit is formed by a generator.

14. The vertical roller mill of claim 10, further comprising a regulator unit for regulating the slippage between said grinding plate and said grinding roller in a prespecified range.

* * * * *